US006904846B2

(12) United States Patent
Schmid et al.

(10) Patent No.: US 6,904,846 B2
(45) Date of Patent: Jun. 14, 2005

(54) IGNITION DEVICE FOR A SAFETY SYSTEM

(75) Inventors: Martin Schmid, Frastanz (AT); Manfred Mähr, Röthis (AT)

(73) Assignee: Hirschmann Austria GmbH, Rankweil Brederis (AT)

( * ) Notice: Subject to any disclaimer, the term of this patent is extended or adjusted under 35 U.S.C. 154(b) by 0 days.

(21) Appl. No.: 10/250,296

(22) PCT Filed: Jan. 12, 2002

(86) PCT No.: PCT/EP02/00249

§ 371 (c)(1),
(2), (4) Date: Oct. 30, 2003

(87) PCT Pub. No.: WO02/055953

PCT Pub. Date: Jul. 18, 2002

(65) Prior Publication Data

US 2004/0065222 A1 Apr. 8, 2004

(30) Foreign Application Priority Data

Jan. 13, 2001 (DE) ..... 101 01 410

(51) Int. Cl.[7] ..... F42B 3/18

(52) U.S. Cl. ..... 102/202.2; 102/202.9; 102/206

(58) Field of Search ..... 102/202.1, 202.2, 102/202.9, 206, 530

(56) References Cited

U.S. PATENT DOCUMENTS

| | | | | | |
|---|---|---|---|---|---|
| 4,374,605 | A | * | 2/1983 | Bratt | 439/578 |
| 5,142,982 | A | * | 9/1992 | Diepold et al. | 102/202.5 |
| 5,200,574 | A | * | 4/1993 | Cunningham et al. | 102/530 |
| 5,241,910 | A | * | 9/1993 | Cunningham et al. | 102/530 |
| 6,418,853 | B1 | * | 7/2002 | Duguet et al. | 102/206 |
| 6,571,712 | B2 | * | 6/2003 | Lebaudy et al. | 102/202.5 |
| 6,662,727 | B2 | * | 12/2003 | Bornheim et al. | 102/530 |

FOREIGN PATENT DOCUMENTS

| | | | |
|---|---|---|---|
| DE | 3242977 | A1 * | 5/1984 |
| DE | 4300342 | A1 | 7/1994 |
| DE | 4413756 | C1 | 7/1995 |
| DE | 19609908 | A1 | 9/1997 |

* cited by examiner

*Primary Examiner*—Michael J. Carone
*Assistant Examiner*—James S. Bergin
(74) *Attorney, Agent, or Firm*—Fulbright & Jaworski, LLP

(57) ABSTRACT

The invention relates to a safety system for an ignition device (7), particularly a safety system for an ignition device (7) to activate an airbag, a belt tightener or a similar type safety device for use in vehicles. The ignition device can be activated by input signals which are fed via supply lines (3,4). At least one electronic component (10) is connected to the supply lines (3,4) using conductors (1), that can be stampings, and a nonconductive carrier (2) retaining the conductors 1.

16 Claims, 3 Drawing Sheets

IGNITION DEVICE FOR A SAFETY SYSTEM

BACKGROUND OF THE INVENTION

1. Field of the Invention

The present invention relates to an ignition device for a safety system, especially an airbag, a belt tensioner, or the like in motor vehicles, and, more particularly, the present invention relates to installation of a protective electronic component with respect to the ignition device for the safety system.

2. Description of the Related Technology

Austrian utility model AT 000522U1 discloses an ignition device for a safety system which can be used for a safety belt tensioner. In the case of this prior known ignition device there is an ignition starter located in a housing, the ignition starter receives signals for activation (i.e. for ignition) via feed lines.

To protect against extraneous voltages or currents formed by incident radiated Electromagnetic (EM) fields or landline High Frequency (HF) waves, at least one electronic component is connected to the feed lines, by which incident radiated EM fields or HF waves are attenuated to the extent that they can no longer trigger misfires of the ignition starter.

In the case of this prior known ignition device it is necessary to place the electronic component within the housing of the ignition device since it may only occupy little installation space. Then, however, if the electronic component is faulty, it is necessary to replace the entire ignition device.

SUMMARY OF THE INVENTION

An object of the present invention is to provide improvement over the known ignition devices in order to overcome the above discussed and inferred disadvantages.

The present invention provides that at least one electronic component is located outside the housing for the ignition starter. In this way the electronic component can be located where there is adequate space. In addition, the space requirement for the at least one electronic component is thus no longer subject to limitations. Now, in fact the electronic component can be optimally configured with respect to its arrangement and its function while simultaneously maintaining its advantageous effects, specifically the effective prevention of misfires.

The electronic component can be coils (inductances), capacitors, varistors and the like devices. It also is conceivable for several of these devices to be used in combination for an electronic component.

As an aspect of the invention the electronic component is connected to feed lines via at least partially electrically conductive lines. This arrangement increases the flexibility of installation, since first the feed lines are connected to a carrier structure and then the electronic component is connected to the carrier structure (or vice versa). Moreover different connecting techniques can be used for the connection between a feed line and the carrier structure on the one hand and the carrier structure and the component on the other. The optimum matching of connecting techniques ensures that both a durable connection can be established and also that the electronic component is not damaged by the connection process.

As one embodiment for the present invention, the carrier structure includes electrically conductive stampings. By using stampings, it is on the one hand possible to provide fixing structures both for the electrically conductive areas of the feed lines and also for the electronic component. Furthermore, by using a stamping the strength is increased and an installation site for the electronic component is provided. It is especially important to increase strength, since feed lines are in general flexible round conductors. Based on their flexibility, it is necessary that at the site at which an electronic component is attached to a feed line a minimum stiffness be maintained. This minimum stiffness is further increased by the stampings being incorporated with a nonconducting support being attached to the stampings. The stiffness also is increased by a nonconductive support which consists, for example, of a plastic component. The combination of stampings and nonconductive support is a carrier.

As yet another aspect of the present invention, at least the electronic component is surrounded by a housing. In this way the electronic component effectively is protected against ambient effects (especially mechanical stress, and also exposure to moisture and electrically conductive particles). Of course, the carrier and the feed lines directed to the electronic components also can be surrounded by the housing. The housing itself can have either fasteners with which it is fixed at an installation site or can have a shape with which it can be inserted in a holder to be retained in a fixed position.

As another aspect of the present invention, the housing, which surrounds the electronic component, can be produced by an injection molding process. After connecting the electronic component to electrically conductive areas of the feed lines, especially using the stampings and support of the present invention, the prefabricated unit can be coated by an injection molding process (or optionally by other likewise usable processes) in order to produce the housing. An injection molding process works especially well since with it the housing can be quickly manufactured, and the housing reliably surrounds the participating components, especially also the ends of the feed lines, so that mechanical strength is clearly improved.

BRIEF DESCRIPTION OF THE DRAWINGS

One embodiment of the present invention to which it however is not limited is described below based on the steps of a production process, and these descriptions are explained using the following figures.

DETAILED DESCRIPTION

Figure 1:
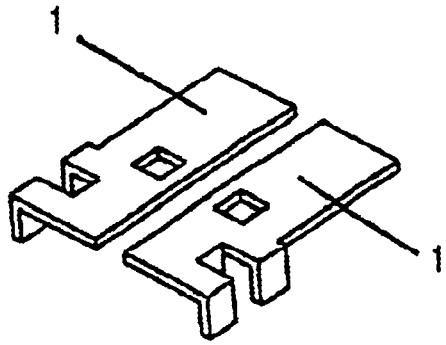
FIG. 1 shows a pair of stampings according to the present inventions.

FIG. 1 shows, by way of example, shaped stampings 1 via which an electronic component 10 can be connected to electrically conductive areas 5 and 6 of feed lines 3, 4.

Figure 2:
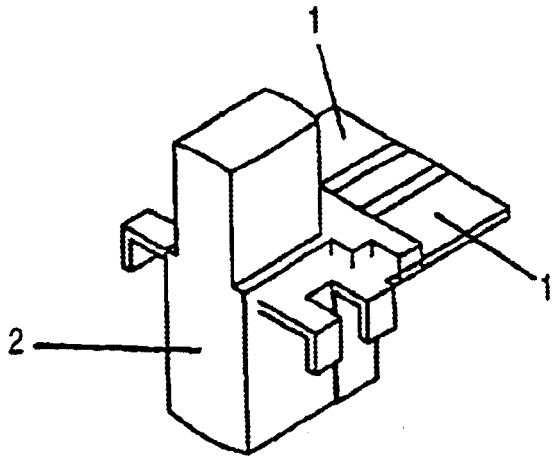
FIG. 2 shows the stampings of FIG. 1 in combination with a support to provide a carrier according to the present invention.

FIG. 2 also shows the stampings 1, which are both electrically conductive, these stampings 1 are fixed at a distance from one another using an electrically nonconductive support 2. The support 2 can be a plastic part into which the stampings 1 are inserted. But it also is conceivable for the stampings 1 to be fixed in positions at a spaced distance from each other, and for the support 2 to be produced, for example, in an injection molding process surrounding the stampings 1.

Figure 3:
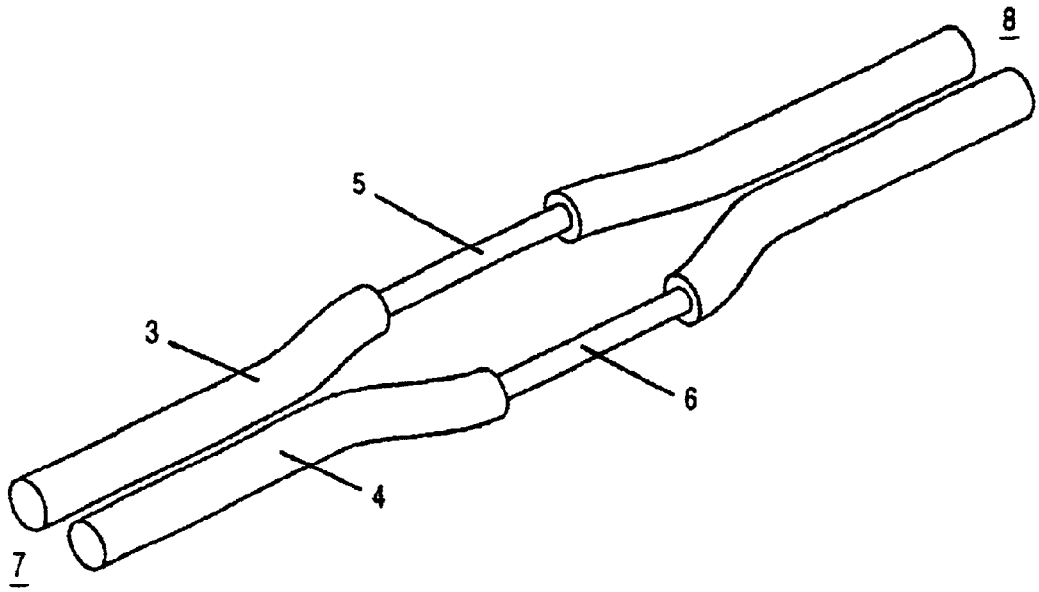
FIG. 3 shows stripped feed lines.

In FIG. 3 two feed lines 3, 4 are shown which are stripped so that the conductors 5 and 6 are exposed. The stripped areas can be located anywhere between a schematically shown ignition device 7 (or ignition starter) and a likewise schematically shown control unit 8 from which the signals for activation of the ignition device originate. It should be mentioned here that the electrical feed lines need not necessarily be made as round flexible conductors. They also can be, for example, rigid flat strip lines or flexible film lines.

Figure 4:
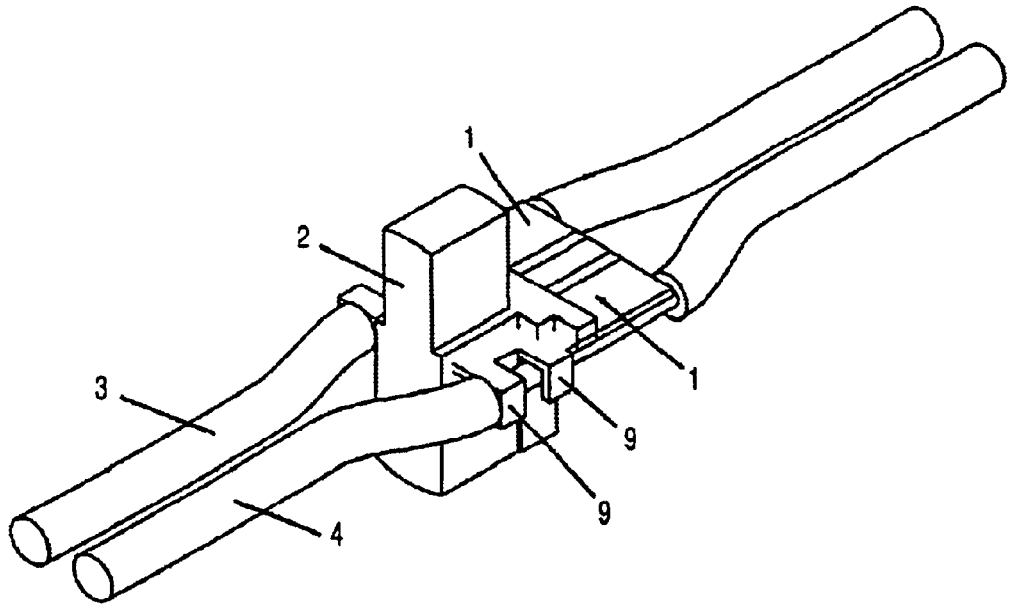
FIG. 4 shows the stampings and support of the carrier, shown in FIG. 2, which are inserted about the stripped areas of the feed lines.

FIG. 4 shows the stripped areas 5 and 6 joined to the stampings 1 and, for example, soldered there. For fixing the conductors 5 and 6 in positions at the front of the stampings there are bends 9; using these bends 9 the conductors 5 and 6 are held on the stampings 1. Instead of soldering it also is conceivable here for the conductors 5 and 6 to be crimped to the stampings 1 via the bends 9.

Figure 5:
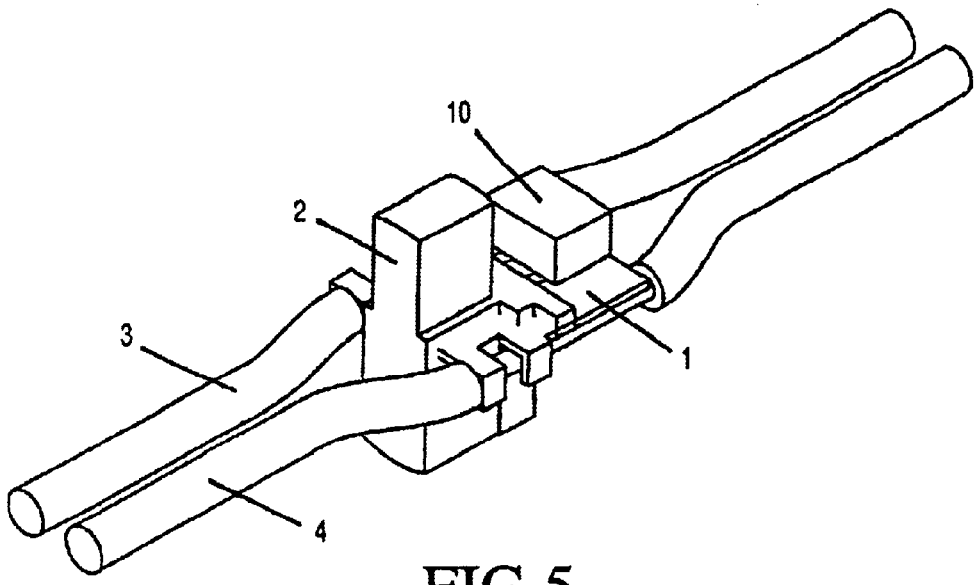
FIG. 5 shows an electronic component installed with the stampings and the support.

FIG. 5 shows a premounted unit provided with an electronic component 10 which is electrically in contact with the stampings 1. Here the electronic component 10 is shown connected parallel to the two feed lines 3 and 4. Of course, the invention alternatively can be implemented with an electronic component connected in series to a feed line. In addition, it is possible to connect one component (or several components) in parallel and another (or other components) in series to the feed lines.

Figure 6:
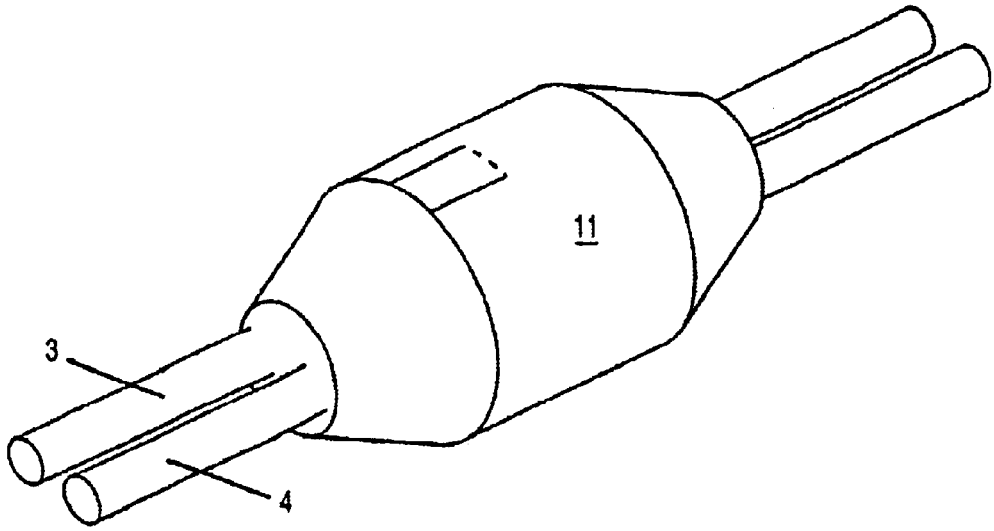
FIG. 6 shows a housing surrounding the carrier structure.

FIG. 6 shows that the electronic component 10 including the stampings 1 and the support 2 can be surrounded by a housing 11. Here this housing 11 is shaped or is located around the premounted unit which is shown in FIG. 5 such that the ends of the feed lines 3 and 4 are surrounded by the housing 11. Thus, a unit is formed which has a required mechanical strength and which protects the sensitive electronic component 10. The housing 11 can completely surround all participating components, it also can be conceivable, for example, for the support 2 to project out of the housing 11 and to be used for attachment purposes.

In another alternative embodiment, which is not shown, it is conceivable that the feed lines 3 and 4 point in the direction of the ignition device 7 or also in the direction of the control unit 8, and that they are not made as feed lines, but as contact partners (especially pins or sleeves). These contact partners being surrounded in a structurally suitable manner by the housing 11 in order to implement an electrical plug connection. Such an electrical plug connection has the advantage that the electronic component 10 can be located outside the housing of the ignition device, but also in the same vicinity in space. Alternatively it is possible for the electronic component 10 to be located within the electrical plug connection on the control unit 8. In addition, the feed lines 3 and 4 which run from the electronic component 10 on the one hand in the direction of the ignition device 7 and on the other in the direction of the control unit 8 can be the same or also different.

What is claimed is:

1. An ignition system having an ignition device, said ignition device can be activated by electric power output from a control unit using at least two feed lines to provide the electric power from said control unit to said ignition device, the ignition system comprising:

an electronic component to filter and attenuate EM fields and HF waves;

a first conductor electrically connected to one of said feed lines;

said electronic component electrically connected to said first conductor so as to be electrically connected to the one of said feed lines;

each of said feed lines being continuously disposed without interconnections between said control unit and said ignition device to provide electric power; and said first conductor retained by a nonconductive carrier, and said nonconductive carrier positioned by said retained first conductor to be adjacent said feed lines;

wherein, said first conductor is electrically connected to the one of said feed lines between said control unit and said first housing enclosing said ignition device.

2. The ignition system according to claim 1 further comprising:

a second conductor electrically connected to the other of said feed lines;

said electronic component electrically connected to said second conductor so as to be electrically connected to the other of said feed lines; and said second conductor retained by said nonconductive carrier so as to be fixed at a spaced apart distance from said first conductor.

3. The ignition system according to claim 2 wherein said second conductor is made by stamping an electrically conductive material.

4. The ignition system according to claim 2 further comprising:

said second conductor having a bend portion disposed so that the other of said feed lines that is electrically connected to said second conductor is positioned to abut to said bend.

5. The ignition system according to claim 4 wherein said bend is disposed to be bent and crimp about and be in electrical contact with the other of said feed lines.

6. The ignition system according to claim 2 further comprising a housing disposed about said electronic component.

7. The ignition system according to claim 6 wherein said housing is made by injection molding.

8. The ignition system according to claim 1 wherein said first conductor is made by stamping an electrically conductive material.

9. The ignition system according to claim 1 further comprising:

said first conductor having a bend portion disposed so that the one of said feed lines that is electrically connected to said first conductor is positioned to abut to said bend.

10. The ignition system according to claim 9 wherein said bend is disposed to be bent and crimp about and be in electrical contact with the one of said feed lines.

11. The ignition system according to claim 1 further comprising a housing disposed about said electronic component.

12. The ignition system according to claim 11 wherein said housing is made by injection molding.

13. An ignition system having an ignition device, said ignition device can be activated by electric power output from a control unit using at least two feed lines to provide the electric power from said control unit to said ignition device, the ignition system comprising:

an electronic component to filter and attenuate EM fields and HF waves;

a first conductor electrically connected to one of said feed lines, said first conductor having a bend portion disposed so that the one of said feed lines that is electrically connected to said first conductor is positioned to abut to said bend;

said electronic component electrically connected to said first conductor so as to be electrically connected to one of said feed lines; and said first conductor retained by a nonconductive carrier, and said nonconductive carrier positioned by said retained first conductor to be adjacent said feed lines;

wherein, said first conductor is electrically connected to the one of said feed lines between said control unit and said ignition device.

14. The ignition system according to claim 13 wherein said bend is disposed to be bent and crimp about and be in electrical contact with the one of said feed lines.

15. An ignition system having an ignition device, said ignition device can be activated by electric power output from a control unit using at least two feed lines to provide the electric power from said control unit to said ignition device, the ignition system comprising:

an electronic component to filter and attenuate EM fields and HF waves;

a first conductor electrically connected to one of said feed lines;

said electronic component electrically connected to said first conductor so as to be electrically connected to the one of said feed lines;

said first conductor retained by a nonconductive carrier, and said nonconductive carrier positioned by said retained first conductor to be adjacent said feed lines;

a second conductor electrically connected to the other of said feed lines, said second conductor having a bend portion disposed so that the other of said feed lines that is electrically connected to said second conductor is positioned to abut to said bend; and said second conductor retained by said nonconductive carrier so as to be fixed at a spaced apart distance from said first conductor.

16. The ignition system according to claim 15 wherein said bend is dispose to be bent and crimp about and be in electrical contact with the other of said feed lines.

* * * * *